US006000973A

United States Patent [19]

Mitra

[11] Patent Number: 6,000,973

[45] **Date of Patent: *Dec. 14, 1999**

[54] ELECTRICAL CONNECTOR WITH PLUG CONTACT ELEMENTS OF PLATE MATERIAL

[75] Inventor: Niranjan Kumar Mitra, Eindhoven, Netherlands

[73] Assignee: BERG Technology, Inc., Reno, Nev.

[ * ] Notice: This patent issued on a continued prosecution application filed under 37 CFR 1.53(d), and is subject to the twenty year patent term provisions of 35 U.S.C. 154(a)(2).

[21] Appl. No.: 08/674,617

[22] Filed: Jul. 3, 1996

Related U.S. Application Data

[63] Continuation of application No. 08/256,752, Oct. 14, 1994, abandoned, filed as application No. PCT/NL93/00021, Jan. 22, 1993.

[30] Foreign Application Priority Data

Jan. 22, 1992 [NL] Netherlands ..... 9200118

[51] Int. Cl.[6] ..... H01R 13/05

[52] U.S. Cl. ..... 439/825

[58] Field of Search ..... 439/601, 660, 439/692, 825, 885, 83, 43, 884, 866

[56] References Cited

U.S. PATENT DOCUMENTS

| | | | |
|---|---|---|---|
| 2,521,298 | 9/1950 | Ludwig | 439/601 |
| 3,288,915 | 11/1966 | Hatfield et al. | 174/94 |
| 3,371,152 | 2/1968 | Damiano | 174/94 |
| 3,425,029 | 1/1969 | Zak | 439/825 |
| 3,588,789 | 6/1971 | Kallus | 439/825 |
| 3,989,331 | 11/1976 | Hanlon | 439/83 |
| 3,993,391 | 11/1976 | Vernerey et al. | 439/866 |
| 4,169,654 | 10/1979 | Plyler et al. | 439/825 |
| 4,437,726 | 3/1984 | Lambert | 439/825 |
| 4,820,207 | 4/1989 | Zic | 439/825 |
| 4,881,905 | 11/1989 | Demler, Jr. et al. | 439/79 |
| 4,908,942 | 3/1990 | Long et al. | 439/82 |
| 5,209,680 | 5/1993 | Fry | 439/825 |
| 5,669,792 | 9/1997 | Naka et al. | 439/825 |

FOREIGN PATENT DOCUMENTS 1540643 2/1963 Germany .

OTHER PUBLICATIONS

IBM Technical Disclosure Bulletin, vol. 15, No. 2 "Split Function Contact", Jul. 1972.

Molex Full Line Catalog No. 870 (Distributed by Pyttronic Industries, Inc., p. 77E (1987).

*Primary Examiner*—Gary Paumen
*Assistant Examiner*—Tho Dac Ta
*Attorney, Agent, or Firm*—Woodcock Washburn Kurtz Mackiewicz & Norris LLP

[57] ABSTRACT

An electrical connector with plug contact elements of plate material is disclosed. The electrical connector comprises a housing of electrically insulating material, provided with at least one contact element of electrically conducting material designed as a plug contact. The plug contact is made up of two substantially oppositely spaced elongated plate parts. An end of each plate part is fixedly connected to a base part of the connector, while free ends of the plate parts are in physical contact. The contact element may be secured in a channel of the housing by a lip-shaped member fixedly joined in a resilient manner to the base part. The contact element is provided with a terminal end adapted for electrically interfacing with other electrical components. A method of making the contact element as a whole by a single punching process from a sheet of electrically conducting material is also disclosed.

24 Claims, 3 Drawing Sheets

FIG. 1
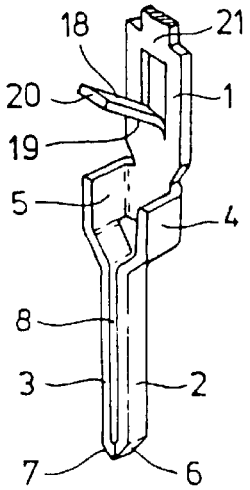
FIG. 2
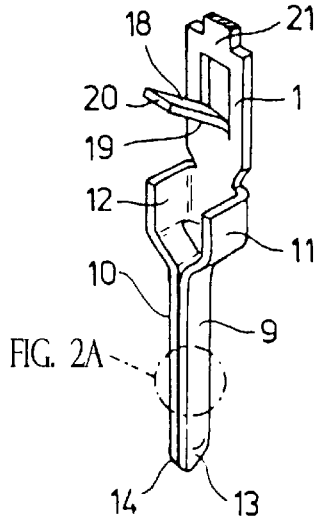
FIG. 3
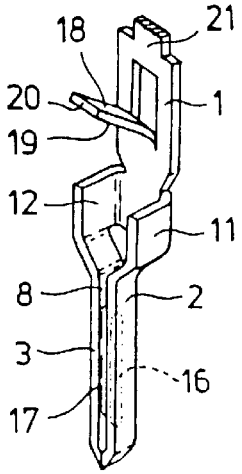
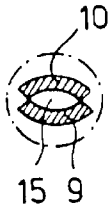
FIG. 2A
FIG. 4
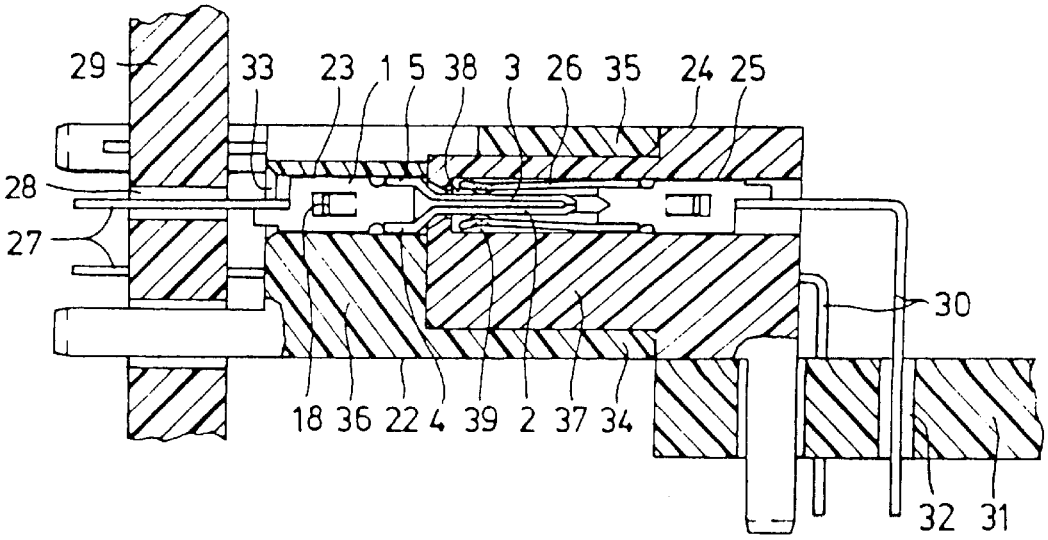

FIG. 5A
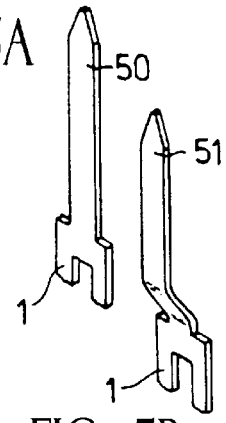
FIG. 5B
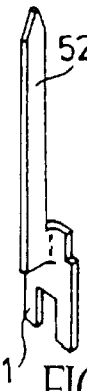
FIG. 5C
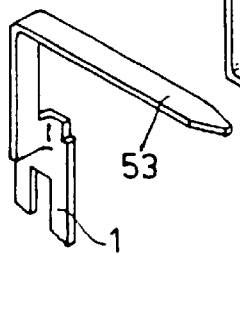
FIG. 5D
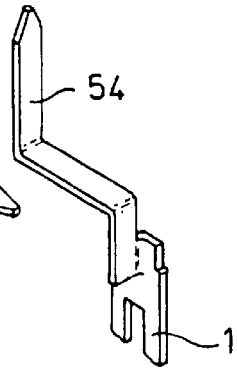
FIG. 5E
FIG. 6A
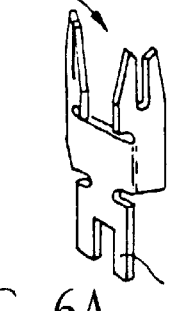
FIG. 6B
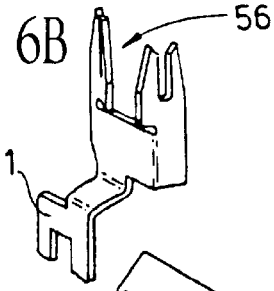
FIG. 6C
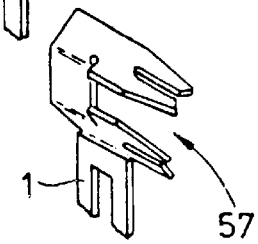
FIG. 7A
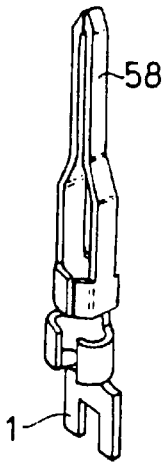
FIG. 7B
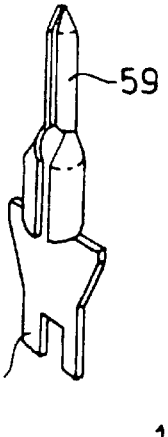
FIG. 7C
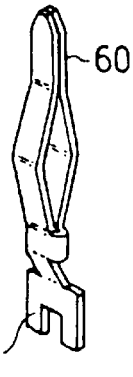
FIG. 8A
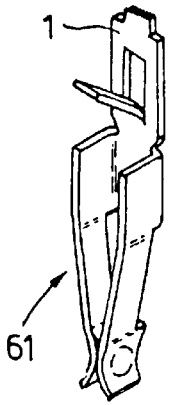
FIG. 8B
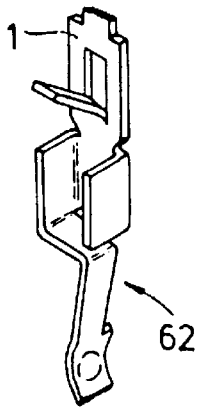
FIG. 8C
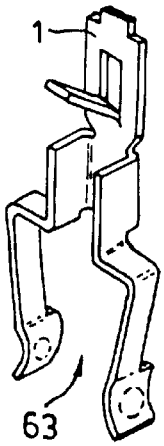

ELECTRICAL CONNECTOR WITH PLUG CONTACT ELEMENTS OF PLATE MATERIAL

This is a continuation, of application Ser. No. 08/256,752, filed Oct. 14, 1994, now abandoned, filed as PCT/NL93/00021 filed on Jan. 22, 1993.

BACKGROUND OF THE INVENTION

The invention relates to an electrical connector comprising a housing of electrically insulating material, provided with at least one contact element of electrically conducting material having a contact end, extending from a base part and designed as a plug contact, for making contact to a further contact element, in which the contact end is made up of two oppositely spaced elongated plate parts extending from the base part, with one end fixedly joined thereto.

An electrical power connector provided with contact elements having a contact end designed as a plug contact of the type mentioned above is known from U.S. Pat. No. 4,881,905.

Plug contact elements are usually made by pressing, flattening or another suitable mechanical processing from stiff, solid electrically conducting material. Embodiments of plug contacts are also known which are made up of two or more solid parts, each having, for example, a circular-sector-shaped cross section. These known plug contacts have the common characteristic that they form a stiff entity.

It has been found that such stiff plug contacts have a number of disadvantages which, in particular, weigh heavily in producing connectors having reduced dimensions for which there is a still growing requirement in view of the current trend for scale reduction (miniaturization) of electronic components.

In contrast to a plug contact element made up of stiff solid material, plug contacts formed from plate material, have certain flexible properties. The two plate parts can be moved in the direction towards and away from one another and can also be displaced with respect to one another. This results in a self-aligning action on making contact to a further contact element having a contact end designed, for example, as socket contact when the two contact ends are not exactly in line with one another. In particular, in the case of connectors having relatively large numbers of plug contacts, for example 80 or more, this self-aligning action has a beneficial effect on achieving as low as possible an insertion force for the making of connector contact. Moreover, this self-aligning action promotes the contact reliability between the contact elements which are to make contact.

In the plug contact element known from U.S. Pat. No. 4,881,905 the two oppositely spaced elongated plate parts are joined to the base part in a cantilevered manner. That is to say, the free ends of the plate parts are not in physical contact with one another. When contacting a further contact element, i.e. a socket contact element, the plate parts are deflected towards each other which produces a certain mechanical stress in the contact element. In order to reduce the amount of deflection and stress without affecting the thickness, length and material constant of the contact element, the width of the plate parts has to be enlarged. This however contraverses the current trend for scale reduction in the electronics field, i.e. designing small pitch miniature connectors.

DE-A-1,540,643 and U.S. Pat. No. 3,371,152 disclose contact elements having connecting ends for wire wrap applications, comprising adjacently spaced elongated plate parts. However these plate parts are connected via an intermediate strip in longitudinal direction. For miniaturisation purposes these connecting ends have an insufficient self-aligning action on mating with a receiving contact element, due to said intermediate connecting strip.

SUMMARY OF THE INVENTION

The object of the invention is therefore to provide an electrical connector having one or more contact elements provided with a contact end designed as plug contact, suitable in particular for miniaturization purposes.

This object is achieved, according to the invention, in that the free ends of the plate parts are in physical contact.

In the contact element designed according to the invention, each plate part acts as a load support for the other, adjacent plate part. Thus, in the design of the invention, each plate part resembles a beam supported at both ends, in contrast to the cantilevered beams of the contact element known from U.S. Pat. No. 4,881,905. It can be demonstrated that when contacting a further contact element, assuming the same length, width, thickness and material constant, the deflection and mechanical stress in the plate parts according to the invention are lower, in the order of magnitude of half the values, compared to the prior art plug contact element.

Accordingly, the plate parts of the contact element according to the invention may have a smaller width compared to the prior art contact element when assuming the other variables constant. The mating socket or female contact element may also be less in width in order to accomodate lateral movements of the plug or male contact element. Hence, the plug contact element designed according to the invention has an inherent capability of producing small pitch miniature connectors, in particular so called signal connectors.

Test results have shown that the plug contact according to the invention causes significantly less wear on repeatedly making and breaking contact with a socket contact element compared with a stiff plug contact element. As an illustration, an unacceptable wear of the conducting coating layer of the socket contact occurred with the contact element according to the invention only after approximately 2000/3000 make-and-break cycles whereas this was already the case for 200/300 cycles with a stiff solid plug contact.

This lower wear of the contact faces of the socket contact and the plug contact according to the invention can be explained, on the one hand, by the property, already mentioned, that the two plate parts of the plug contact according to the invention are compressible in the direction of one another. As a result, after introducing the free end of the plug contact into the socket contact, a contact force or normal force acts on the contact faces during the further introduction of the plug contact, which force is lower than in a comparable stiff, solid plug contact. In the latter case, this is because the normal force between the contact faces of the socket contact and the plug contact remains equal to the contact force after introducing the contact end of the relevant plug contact. It will be clear that, in the latter case, a greater normal force is exerted on the contact faces during the further introduction of the plug contact into the socket contact over a longer distance than in the case of the compressible plug contact according to the invention, which results, of course, in greater wear of the contact faces.

Because the contact element according to the invention is made of plate material without the need for a pressing or flattening processing of the contact surface as in the case of a plug contact made of solid material, the contact surface in the plug contact of the invention will be less rough than in a contact element known from the prior art, and this also has, on the other hand, a beneficial effect on the wear of the contact layer of the socket contact.

Although the physical contact of the free ends of the plate parts can be achieved using an intermediate member, in the preferred embodiment of the invention the plate parts touch one another at their free ends. With this embodiment, damage to a socket contact is avoided as much as possible, because when the plug contact and a socket contact mate, the respective processed free ends of the plate parts do not engage the contact surface of the socket contact. A possible disturbance of the surface accuracy of the plate parts due to the mechanical action to cause the two plate parts to touch will not have a disadvantageous effect on the contact surface wear.

If, however, connectors having plug contacts of greater stiffness are required for particular applications, this can be achieved, according to yet a further embodiment of the invention, in that the plate parts between the fixed and free end thereof are provided with one or more protuberances which face one another. By means of this relatively simple mechanical processing, the stiffness of the plug contact can expediently be increased to a desired value.

An advantageous embodiment of a connector having one or more plug contacts according to the invention is that in which the two plate parts are flat and have a flat contact surface, and form the boundary of an interspace having an essentially hollow rectangular cross section. This plug contact can be made without damaging the faces which come into contact with the contact faces of a socket contact made of flat plate material having a predetermined surface accuracy and can be provided with desired spring properties by a suitable dimensioning.

An embodiment of a connector having a plug contact according to the invention, capable in particular of absorbing tolerance differences between mating connectors, is one wherein the two plate parts have a contact surface which is curved transversely to their longitudinal direction and form the boundary of an interspace having an essentially hollow, cylindrical cross section. The radius of curvature of the two plate parts can be relatively large, so that the surface accuracy of the two plate parts is not affected, or hardly affected, by the curving thereof.

To facilitate the introduction of the plug contact into a socket contact, in yet a further embodiment, the free ends of the plate parts are designed to taper towards one another, for example in conical or prismatic form.

In the case of a connector having a housing provided with one or more channels for receiving a contact element, the base part comprises a flat plate provided with means for securing the contact element in the relevant channel of the housing. Suitable means for this purpose are, for example, retention hooks which, in the assembled state act on one or more walls of the channel and provide the necessary force for securing the contact element in the relevant channel by deforming (biting into) the surface of the walls.

In the preferred embodiment of the connector according to the invention which is particularly suitable for miniaturisation purposes, the securing means consist of at least one lip-shaped member which is raised with respect to the base part, which lip-shaped member has an end which is joined in a resilient manner to the flat base part and a free end which is raised with respect to the base part, which free end acts on a wall part of the associated channel of the housing in the assembled state of the contact element.

The lip-shaped member provides an adaptive securing action. In the state of the connector where contact has not been made, relatively light forces are exerted on the relevant wall parts of the channels as a consequence of the spring action of the lip-shaped member. When the contact elements make contact, however, the base part is pressed with force against the opposite wall part of the channel by the lip-shaped member, as a result of which an adequate securing force is provided in the insertion direction of the connector. The lip-shaped member causes no, or virtually no, mechanical damage (biting into) to the walls of a channel, as a result of which the securing member is particularly suitable for use in housings having relatively thin walls.

To connect the plug contact according to the invention to an electrical wiring, it is provided, in yet a further embodiment of the connector according to the invention, with a terminal end which is optionally designed as insulation-displacement contact, as solder end, as wire-wrap terminal pin, or for clamping (press-fit, press-in) reception thereof in an aperture of a substrate. Of course, instead of a terminal end for wiring, the plug contact may also be provided with a further contact end which may also be designed per se as a plug contact or, for example, as a socket contact.

To prevent undesired rotation of the contact element in a channel of the housing, in yet a further embodiment of the connector according to the invention, wherein the housing is provided with channels having an essentially rectangular cross section, the fixed ends of the two plate parts and the adjoining base part form an essentially U-shaped cross section, the cross-sectional dimensions of the channel and the U-shaped section being mutually matched.

In particular, in contact elements provided with a terminal end for solder mounting, the hollow plug contacts according to the invention furthermore have the advantage that the space between the two plate parts functions as a receiving reservoir for solder flux. This appreciably reduces the risk of the outside surface, which makes contact, of the two plate parts being contaminated or coated with solder flux. This is in contrast to the solid contact elements known from the prior art in which solder flux can in general easily flow along the outside contact surface. The solder flux results in a corrosive action on the contact surface of the plug contact, due to which an additional cleaning treatment of the plug contacts is necessary in the case of such solid contact elements. It will be clear that this has an unfavourable effect on the cost price of the connector.

Compared with a similarly dimensioned solid plug contact, the plug contact according to the invention has better heat dissipation properties as a result of its relatively larger plate surface, due to which the plug contact according to the invention can carry a higher electrical current than a comparable solid plug contact. As a result of its greater heat dissipation capacity, the plug contact according to the invention is also suitable, in particular, for solder assembly.

Because relatively small thicknesses of plate material can be employed, the capacitive coupling between plug contacts situated adjacently to their edges will be less than in the case of solid, for example, square or rectangular, plug contacts. A small mutual capacitive coupling between the contact elements for a given pitch makes it possible to process signals of higher frequency. In view of the present trend to an ever faster processing of, for example, digital signals, this is also advantageous.

The contact element according to the invention can advantageously be made as a whole by a single punching process from a sheet of electrically conducting material, the surfaces remote from the punching direction being positioned facing one another, for example, by folding. This has the advantage that any burrs extending in the punching direction at the edges of the two plate parts extend into the interspace between the two plate parts and the surfaces of the plate material facing outwards remain undamaged for making contact to a further connector for the purpose of the invention. It will be clear that this has a beneficial effect on the wear, the contact reliability and the contact resistance on making contact to a further connector.

The invention also relates to a contact element as described above for use in an electrical connector and/or for mounting on a printed circuit board.

The invention is explained in greater detail below by reference to some preferred embodiments.

BRIEF DESCRIPTION OF THE DRAWINGS

FIGS. 1, 2*a*, 3 show diagrammatically and in perspective various preferred embodiments of contact ends according to the invention designed as a plug contact.

FIG. 4 shows diagrammatically a cross-sectional view of a connector having a plug contact according to the invention in the position where contact is made to a further connector.

FIGS. 5*a*, 5*b*, 5*c*, 5*d*, 5*e*, 6*a*, 6*b*, 6*c*, 7*a*, 7*b* and 7*c* show diagrammatically and in perspective various embodiments of terminal ends for a plug contact according to the invention.

FIGS. 8*a*, 8*b* and 8*c* shows diagrammatically and in perspective various embodiments of a further contact end for combination with the plug contact according to the invention.

DETAILED DESCRIPTION OF THE EMBODIMENTS

Figure 9:
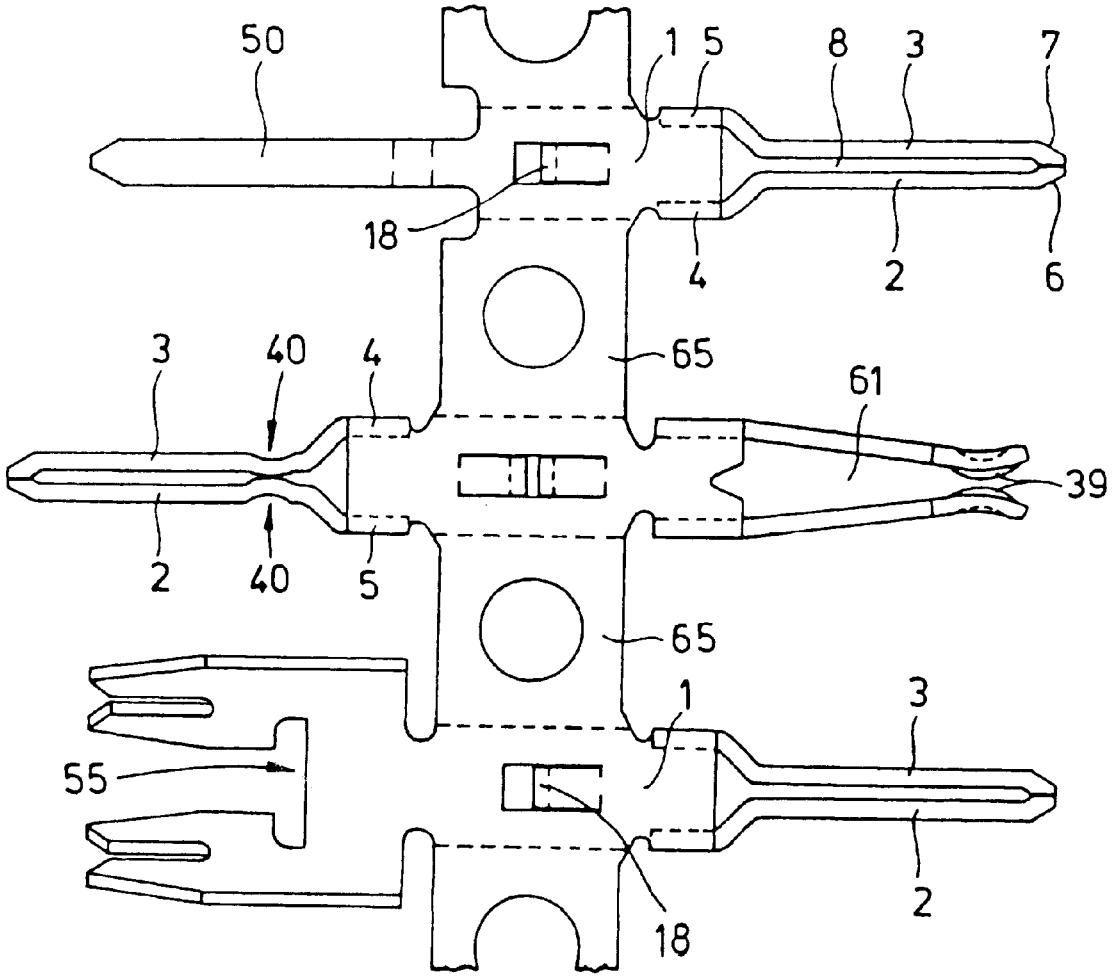
FIGS. 9 illustrates in elevation plug contacts according to the invention, made from a sheet of electrically conducting material, in combination with a terminal end or further contact elements according to one or more of FIGS. 5 to 8 inclusive.

FIG. 1 shows a section of a contact element according to the invention having a base part 1 in the form of a flat plate, at one end of which two elongated flat plate parts 2, 3 extend opposite one another, which plate parts are joined in a fixed manner to the base part 1 by means of an end 4 or 5, respectively, and form a plug or male contact according to the invention. The free ends 6 and 7, respectively, of the two plate parts 2, 3 are designed to taper in prism form towards one another, such that they touch one another. Between the two plate parts 2, 3 there is a hollow interspace 8 having an essentially rectangular cross section.

FIG. 2 shows a plug contact according to the invention, made up of plate parts 9, 10 as in FIG. 1, which plate parts 9, 10 form the boundary of a curved surface, as is shown enlarged in cross section. The two curved plate parts 9, 10 are joined in a fixed manner to the base part 1 by means of an end 11 or 12, respectively, and their free ends 13 and 14, respectively, are designed to taper conically and touching one another. As is evident from the enlarged cross section, the curved plate parts 9, 10 form the boundary of an essentially elliptical cylindrical hollow interspace 15.

Instead of the elliptical cross section 15 shown, the two plate parts 9, 10 can, of course, form the boundary of any other suitable cross section, for example, a circular or saddle-shaped cross section.

The two plate parts 6, 7 or 9, 10, respectively, have certain flexible spring properties, as a result of which they can be moved in the direction to, and away from, one another and can be displaced with respect to one another. As a result, the plug contact has a self-aligning action on making contact to a further contact element if the two contact ends do not lie precisely in line with one another or if the centre lines of the two contact elements make an angle with one another, which may occur in practice as a consequence of tolerances in the dimensions of the connector housings and/or of the contact elements themselves. The insertion force for making contact with the flexible self-aligning plug contact according to the invention is less than in a comparable solid, stiff plug contact. This is advantageous, in particular, when connectors having a plurality of contact elements, for example 80 or more, mate.

A plug contact made up of flat plate parts 2, 3 has a greater flexible action than a plug contact made up of curved plate parts, for example the plate parts 9, 10. Apart from the shape of the plate parts, the flexible properties of the plug contact according to the invention may also be affected by providing protuberances 16, 17 in the direction of the interspace 8 in one or both surfaces of the plate parts, as shown in FIG. 3.

To secure the plug contact in a channel of a housing, the base part 1 is provided with securing means, for example in the form of a lip-shaped securing member 18 which extends from the face of the base part 1 and which is formed out of the face of the base part 1 in the embodiment shown. The lip-shaped securing member 18 is in this case joined in a fixed and resilient manner to the base part 1 by means of its end 19 adjacent to the plug contact, whereas the free end 20 of the securing member 18 is raised with respect to the base part 1 adjacent to a terminal end 21 joined to the base part 1, which terminal end 21 is shown partly broken away in FIGS. 1–3.

FIG. 4 shows in cross-sectional view, a connector 22 provided with a plurality of contact elements 23 having a plug contact according to FIG. 1 in the position where contact is made to a further connector 24 provided with a plurality of contact elements 25 each having a socket, or female contact 26. In the embodiment shown, the contact element 23 has a terminal end in the form of a solder end 27 which is received in an opening 28 of, for example, a printed circuit board 29 for connection to the printed circuit board 29 by means of soldering. The contact elements 25 in the connector 24 are also provided with a terminal end in the form of a solder end 30 for connection by soldering in an opening 32 of a printed circuit board 31.

The contact element 23 extends in a channel 33 of the connector 22 by means of its base part 1 and the ends 4, 5 of the two plate parts 2, 3, which ends 4, 5 form the boundary, together with the relevant end of the base part, of a U-shaped cross section. The cross-sectional dimensions of this channel 33 are matched to the dimensions of the base part 1 and the U-shaped end formed by the ends 4, 5 or 11, 12, respectively, in the embodiment of FIG. 2 in such a way that rotation of the plug contact is impeded as much as possible. The plug contact itself extends in a U-shaped space formed by walls 34, 35 and a bottom part 36 of the plastic connector housing, for receiving a section 37 of the plastic housing of the connector 24, in which section 37 channels 38 are formed for receiving the socket contacts 26.

In the position shown in which the plug contact according to the invention and the socket contact 26 mate, it can clearly be seen that the contact faces 39 of the socket contact 26 make contact to the plate parts 2, 3 or 9, 10, rspectively, of the plug contact in the vicinity of their end 4, 5 or 11, 12, respectively, which is joined in a fixed manner to the base part 1.

During the insertion of the two connectors 22, 24, the socket contact 26 is opened by means of the relatively stiff free end of the plug contact, comparable to the insertion of a stiff plug contact. During the subsequent further insertion of the connectors, a lower normal force will be exerted on the contact faces of the outwardly facing surface of the plate parts 2, 3; 9, 10 than in the case of a stiff plug contact with uniform cross section as a consequence of the flexible action of the two plate parts 2, 3 or 9, 10, respectively, of the plug contact according to the invention which are able to move in the direction of one another, whereas the normal force between the contact faces of a known stiff plug contact remaining the same during the insertion of the connectors. The reduction in the normal force with the plug contact according to the invention contributes to a lower wear of the relevant contact faces. As a result, a larger number of make-and-break cycles can be carried out with the plug contact according to the invention than with a stiff plug contact according to the prior art before an unacceptable wear of the contact faces occurs. Tests have shown that the number of make-and-break cycles with the plug contact according to the invention can be a factor of 10 higher than with a known stiff plug contact.

The plug contacts shown in FIG. 1, 2 and 3 can be provided with terminal ends 21 in the form of, for example, solder or wire-wrap pins 50–54, as shown in FIGS. 5*a*–*e*, the pins 53 and 54 being suitable, in particular, for surface mounting technology, or in the form of, for example, insulation-displacement contacts 55, 56, 57, as shown in FIGS. 6*a*–*c* or in the form of, for example, terminal ends 58, 59, 60 suitable for clamping in an opening of a substrate, as shown in FIGS. 7*a*–*c*, alternatively referred to as press-fit or press-in terminal ends.

In addition to terminal ends for the connection of electrical wiring, the plug contact according to the invention may, of course, also be provided with a further plug contact joined to the base part 1, or with a further contact end designed as socket contact 61, or with a further contact end, designed as contact finger 62, for making contact, for example, to a contact face at the edge of a substrate, or with a contact end 63, equipped with two contact fingers situated at a distance from one another, for making contact, for example, to contact faces on both sides of a printed circuit board, as shown respectively in FIGS. 8*a*–*c*.

FIGS. 9*a*–*c* show various contact element combinations having a plug contact according to FIG. 1 viewed towards the edges of the flat plate parts 2, 3, which have been made by punching and then folding from a sheet 65 of electrically conducting material having a thickness, for example, of 0.15 mm.

FIG. 9*a* shows a plug contact having a solder end 50, FIG. 9*b* shows a plug contact having a socket contact 61, and FIG. 9*c* shows a plug contact having an insulation-displacement contact 55. The plug contact shown in FIG. 9*b* has protuberances 40 provided near the fixed ends 4, 5 of the plate parts, which protuberances 40, like the protuberances 16, 17 shown in FIG. 3, serve to increase the stiffness of the plug contact. The contact face of the plug contact is not affected by the protuberances 40.

It will be clear that the invention is not limited to the embodiments shown, but that deviations and additions which are obvious to the person skilled in the art are possible without departing from the inventive idea underlying the invention. The connector according to the invention is in no way limited solely to contact elements having a contact end designed as a plug contact but may also contain other contacts, for example socket contacts, in addition to plug contacts.

I claim:

1. An electrical connector comprising:

a housing of electrically insulating material; and a plug contact element formed from a sheet of electrically conducting material, said contact element comprising:

a base part comprising a flat plate section, said flat plate section defining a base plane, and a contact end extending from said base part, said contact end having a slot dividing said contact end into a first cantilever elongated plate part and a second cantilever elongated plate part, said first plate part substantially parallel to said second plate part, said plate parts defining a contact plane therebetween, said contact plane substantially perpendicular to said base plane, said plate parts and said flat plate section forming a U-shaped boundary of an interspace, each said plate part having a fixed end and a free end, the fixed end of each said plate part fixedly joined to said base part and integrally formed with edges of said flat plate section, the free end of said first plate part in physical contact with the free end of said second plate part in a mutually supporting, non-attached configuration.

2. The electrical connector according to claim 1, wherein the plate parts, between the fixed and free end thereof, are provided with one or more protuberances which face one another.

3. The electrical connector according to claim 1, wherein the two plate parts are flat and have a flat contact surface, and form the boundary of a prismatic interspace having a substantially rectangular cross-section.

4. The electrical connector according to claim 1, wherein the two plate parts have a contact surface which is curved transversely to their longitudinal direction and form the boundary of a substantially cylindrical interspace.

5. The electrical connector according to claim 1, wherein the free ends of the two plate parts are designed to taper in an approximately conical or prismatic form.

6. The electrical connector according to claim 1, wherein the housing is provided with channels having an essentially rectangular cross section for receiving a contact element, the fixed ends of the two plate parts and the adjoining base part forming the boundary of an essentially U-shaped cross section, the cross-sectional dimensions of the channel and the U-shaped section being mutually matched to secure the contact element so as to impede rotation.

7. The electrical connector according to claim 1, wherein the contact element is provided with a second contact end, extending from the base part, for making contact to a second connector, which second contact end is optionally designed as a plug contact or socket contact.

8. The electrical connector according to claim 1, wherein the contact element is adapted for mounting on a printed circuit board.

9. The electrical connector according to claim 1, wherein the base part comprises a flat plate provided with means for securing the contact element in a channel of the housing.

10. The electrical connector according to claim 9, wherein the securing means comprise at least one lip-shaped member which is raised with respect to the flat base part, which lip-shaped member has an end which is fixedly joined in a resilient manner to the base part and a free end which is raised with respect to the base part, which free end acts on a wall part of the associated channel of the housing.

11. The electrical connector according to claim 1, wherein the contact element is provided with a terminal end extending from the base part, the terminal end being adapted for electrically interfacing with other electrical components.

12. The electrical connector according to claim 11, wherein the terminal end is an insulation-displacement contact.

13. The electrical connector according to claim 11, wherein the terminal end is a solder end.

14. The electrical connector according to claim 11, wherein the terminal end is a wire-wrap terminal pin.

15. The electrical connector according to claim 11, wherein the terminal end is a press-fit terminal end suitable for insertion into an opening of a substrate.

16. The electrical connector of claim 1, wherein said contact element is a signal contact.

17. The electrical connector of claim 16, wherein said sheet of electrically conductive material has a thickness of about 0.15 mm.

18. The electrical connector of claim 17, wherein each said plate part has a width of about three times the thickness thereof.

19. An electrical connector comprising:

a housing of electrically insulating material, and a contact element formed from a sheet of electrically conducting material, said contact element comprising: a base part comprising a flat plate section, and a contact end extending from said base part, said contact end having a slot dividing said contact end into a first cantilever elongated plate part and a second cantilever elongated plate part substantially parallel to said first plate part, wherein each said plate part has a fixed end integrally formed with an edge of said flat plate section, said flat plate section and said fixed ends defining a first interspace having a U-shaped boundary, wherein each said plate part has a middle part that forms a boundary of the entire periphery of a second interspace, and wherein each said plate part has a free end, the free ends of said plate parts tapering toward one another such that the free end of said first plate part is in mutually supporting, non-attached contact with the free end of said second plate part.

20. The electrical connector of claim 19, wherein said second interspace has a substantially uniform cross-section along the boundary formed by said middle parts.

21. The electrical connector of claim 20, wherein said cross-section is substantially rectangular.

22. The electrical connector of claim 20, wherein said cross-section is substantially elliptical.

23. The electrical connector of claim 20, wherein the free ends of said plate parts taper so as to form a substantially prismatic end of said contact element.

24. The electrical connector of claim 20, wherein the free ends of said plate parts taper so as to form a substantially conical end of said contact element.

* * * * *